US008176648B2

(12) United States Patent
Bradley

(10) Patent No.: US 8,176,648 B2
(45) Date of Patent: May 15, 2012

(54) CONSTRUCTION BRACKET

(76) Inventor: Bret Bradley, Boise, ID (US)

( * ) Notice: Subject to any disclaimer, the term of this patent is extended or adjusted under 35 U.S.C. 154(b) by 337 days.

(21) Appl. No.: 12/576,141

(22) Filed: Oct. 8, 2009

(65) Prior Publication Data

US 2010/0083519 A1 Apr. 8, 2010

Related U.S. Application Data

(60) Provisional application No. 61/103,627, filed on Oct. 8, 2008.

(51) Int. Cl.
*E04G 21/18* (2006.01)
*G01B 3/30* (2006.01)

(52) U.S. Cl. ..... 33/613; 33/562; 269/904

(58) Field of Classification Search ..... 33/613, 33/562; 269/43, 904, 909, 910
See application file for complete search history.

(56) References Cited

U.S. PATENT DOCUMENTS 2,884,469 A 5/1959 Wursch
2,911,022 A * 11/1959 Brown ..... 269/40
2,969,819 A * 1/1961 Bravo ..... 403/269
2,991,857 A * 7/1961 Soderberg ..... 52/750
3,539,174 A * 11/1970 Borello ..... 269/319
4,300,754 A 11/1981 Lawrence
4,392,643 A 7/1983 Campeau
5,054,755 A * 10/1991 Hawkes ..... 269/3
5,357,054 A 10/1994 Beckerich
5,937,531 A 8/1999 Menk
6,279,885 B1 8/2001 Leon, Jr.
6,293,028 B1 9/2001 Sylvia
6,401,423 B1 * 6/2002 Bergeron et al. ..... 52/855
6,486,436 B1 11/2002 Shah
6,708,964 B1 3/2004 Dedrick
6,718,724 B2 * 4/2004 Thomas ..... 52/749.1
6,820,342 B2 * 11/2004 Ramsthaler ..... 33/41.4
6,895,684 B1 5/2005 Firth
7,009,480 B2 3/2006 Tsui
7,148,776 B2 12/2006 Day
D593,886 S * 6/2009 Mirer et al. ..... D10/71
2011/0219724 A1 * 9/2011 Davis ..... 52/745.09

FOREIGN PATENT DOCUMENTS

JP 10140841 A * 5/1998
WO WO 2010025089 A1 * 3/2010

* cited by examiner

*Primary Examiner* — R. A. Smith
(74) *Attorney, Agent, or Firm* — Robert L. Shaver; Dykas & Shaver, LLP

(57) ABSTRACT

A construction bracket to aid in framing steel stud walls.

13 Claims, 4 Drawing Sheets

CONSTRUCTION BRACKET

CROSS-REFERENCE TO RELATED APPLICATIONS

This application claims the priority date of the provisional application entitled Construction Bracket filed by Brett Bradley Oct. 8, 2008, with application Ser. No. 61/103,627, the disclosure of which is incorporated by reference

FIELD OF THE INVENTION

The invention relates generally to a tool to aid framing walls, and more particularly to a clamp for spacing steel studs.

BACKGROUND OF THE INVENTION

When commercial buildings are constructed, the floors are often completed before the exterior walls are installed. After the building frame is erected, the floors are supported by attachment to the various members of the building frame. The exterior walls are then attached to the floors which in turn provide support and stability to the walls.

The floors are typically a pan made of a corrugated steel deck with steel sidewalls. Concrete is poured into this pan to complete the floor. To connect the exterior wall steel studs to a floor, a worker kneels along the edge of the floor; measures and marks the steel stud locations along the vertical face of the floor sidewall; welds steel angle brackets to the floor sidewall at each mark; then welds steel studs to the steel angle brackets. This is backbreaking work because one must lean over the edge of the floor to complete the weld. Often the marks are in the wrong place, resulting in steel angle brackets and steel studs that have to be removed and re-welded to the correct placement.

A tool to aid in the proper placement and spacing of steel angle brackets and steel studs is needed. The tool should facilitate quick and secure attachment of the tool to the building structure assuring proper placement of a number of steel angle brackets and steel studs. It also must be quick and easy to release the tool from the building structure and reposition the tool for installation of the next group of steel angle brackets and steel studs. When in use the tool should hold the steel angle brackets and steel studs securely in position for attachment.

SUMMARY OF THE INVENTION

A construction bracket for spacing steel angle brackets and steel studs along the perimeter or edge of a building floor while the steel angle brackets and steel studs are attached to the floor sidewall. The bracket body is an elongated member that is placed along the edge of the floor. The bracket body may be made of a rectangular aluminum bar stock or an aluminum angle. Steel or other material of lightweight and adequate strength may also be used to build the bracket body.

A positioning magnet is connected to one or more magnet brackets. The magnet brackets are attached to the bracket body. The positioning magnet has an on-off switch that allows the construction bracket to be removably attached to the vertical face of the floor sidewall. When the on-off switch is in the on, the positioning magnet will securely hold itself and the construction bracket in the desired location along the edge of the building floor by holding firmly to the vertical face of the floor sidewall. When the on-off switch is moved to the off position, the magnetic connection between the positioning magnet and the steel vertical face of the floor sidewall is released and the construction bracket may be easily removed or repositioned.

A number of paddles are attached to the side of the bracket body. The paddles are oriented normal to the bracket body. The paddles are also oriented vertically when the bracket body is placed in use along the edge of a floor. The paddles are generally L shaped, the first leg is attached to the bracket body and extends horizontally away from the bracket body and past the edge of the floor when in use. The second leg of the paddle extends down from the first leg, past the edge of the floor. When in use, the second leg of the paddle is parallel to the vertical face of the floor sidewall.

Paddle spacing is determined by the specifications for the building framing. While the most common spacing for steel studs is 16 inches, other spacing may be specified.

Each paddle includes a clamp for holding steel angle brackets and steel studs. The clamps may be permanent magnets for holding steel angle brackets or steel studs. The clamps may also be other than permanent magnets, such as toggle clamps of the type commonly used to hold parts on jigs and fixtures may be used as clamps to hold steel angle brackets or steel studs.

The construction bracket is placed in the desired position along the edge of the building floor and secured to the floor sidewall by turning the positioning magnet on-off switch to the on position. After the construction bracket is secured in position, steel angle brackets or steel studs may be placed against the clamps where they will be held securely for attachment to the floor sidewall. Steel angle brackets or steel studs are simultaneously held in the desired position relative to each other and to the building structure by the construction bracket. Attachment is normally made by welding steel angle brackets to the vertical face of the floor sidewall; then the steel studs are welded to the steel angle brackets.

DESCRIPTION OF THE PREFERRED EMBODIMENTS

Figure 1:
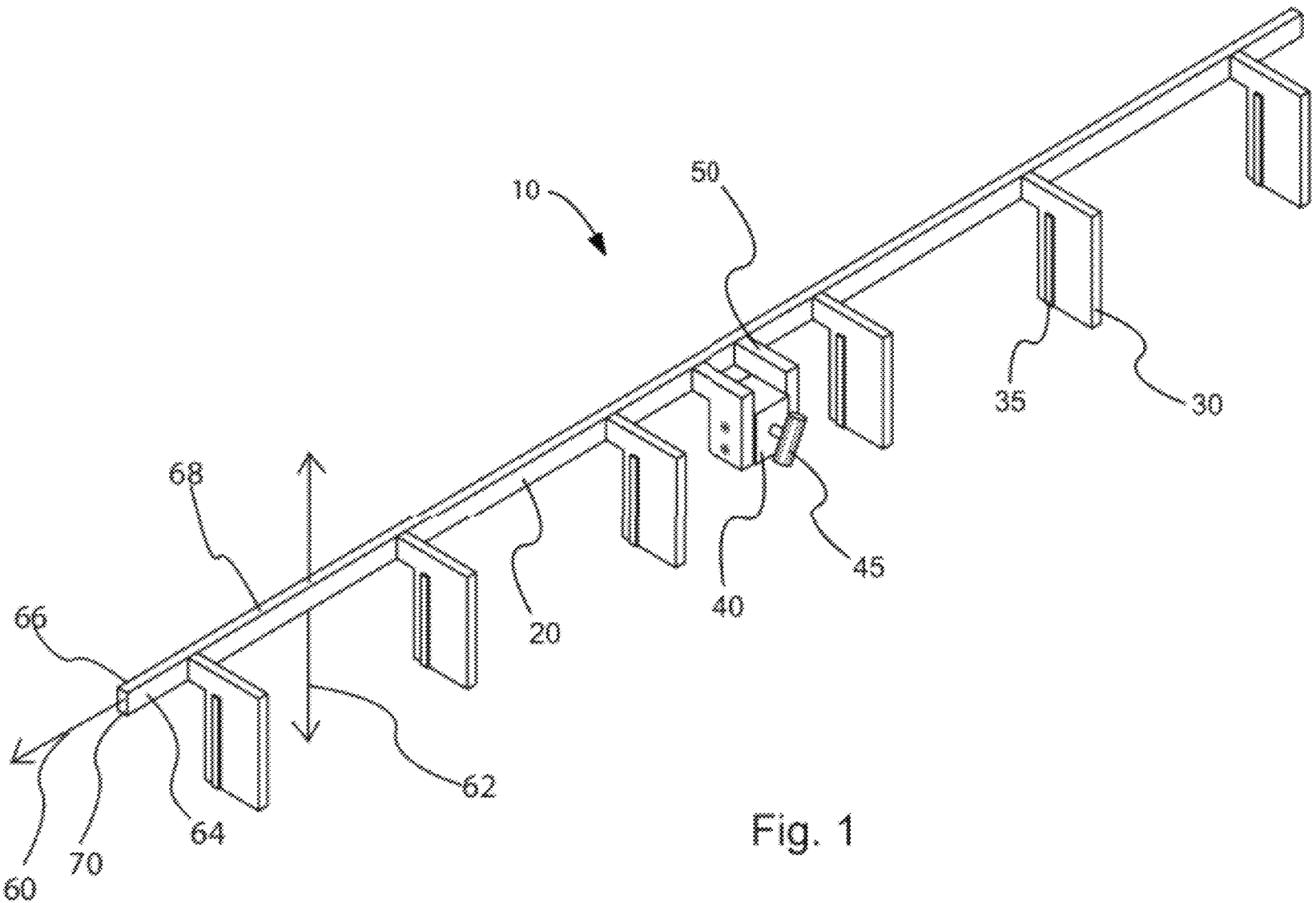
FIG. 1 is a perspective view of a preferred embodiment.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the following description and in the figures, like elements are identified with like reference numerals. The use of "or" indicates a non-exclusive alternative without limitation unless otherwise noted. The use of "including" means "including, but not limited to," unless otherwise noted.

Figure 2:
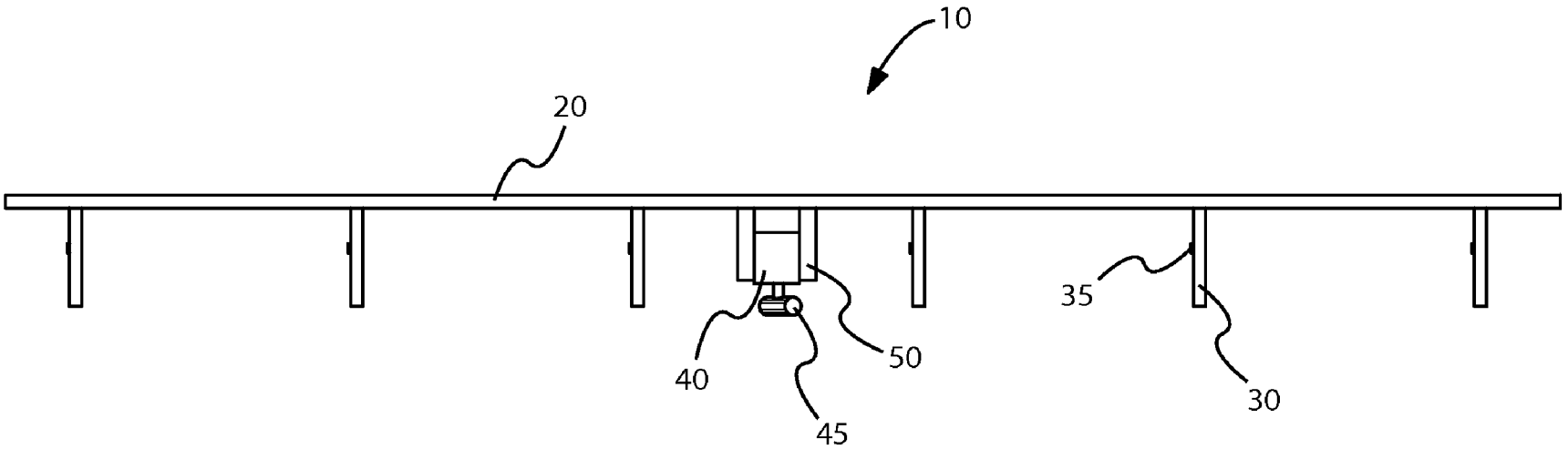
FIG. 2 is a plan view of a preferred embodiment.
Figure 4:
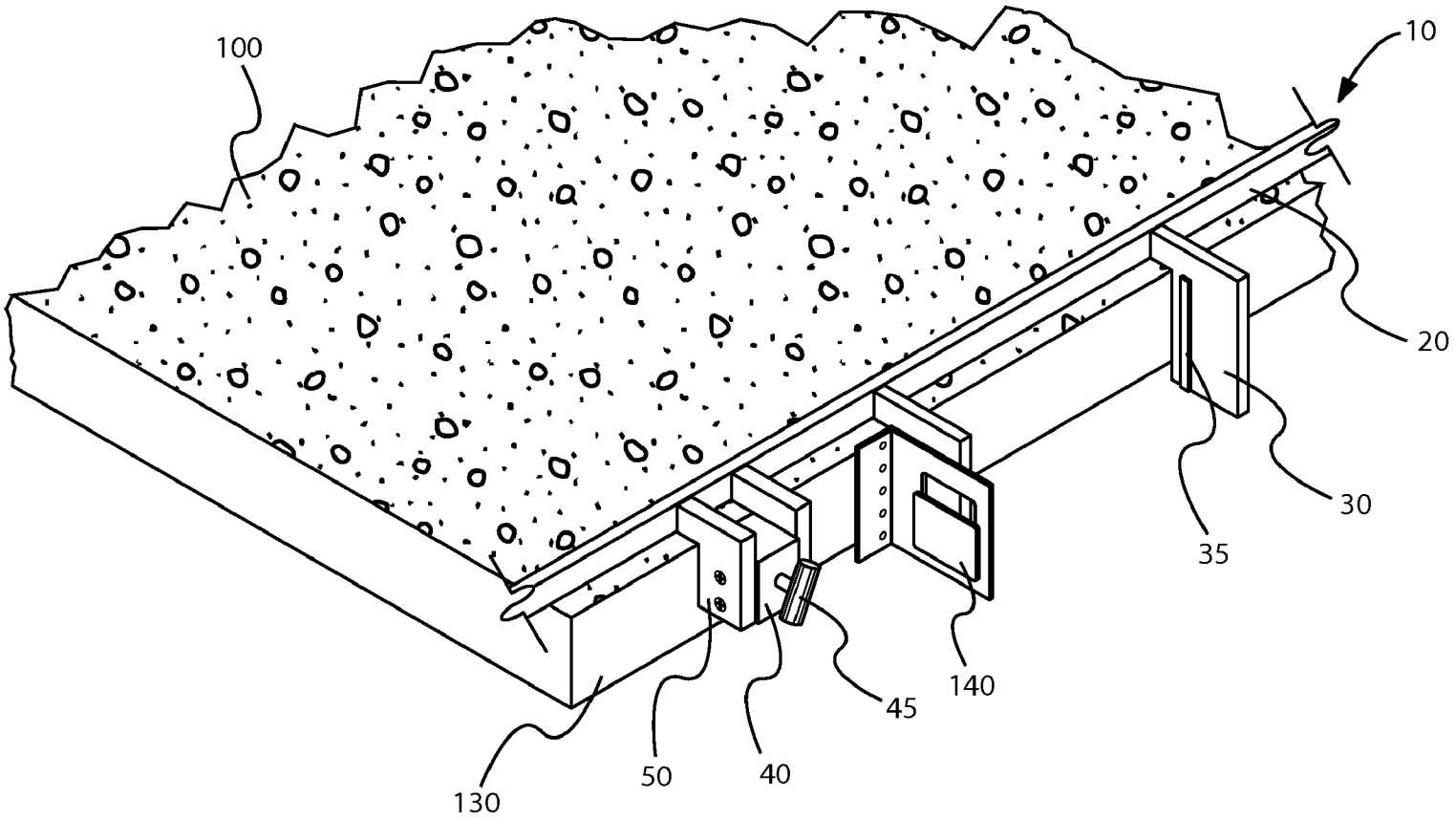
FIG. 4 is a perspective view of a preferred embodiment in use.

FIGS. 1, 2, and 4 illustrate a preferred embodiment of the invention. The construction bracket 10 includes a bracket body 20 preferably made of rectangular aluminum bar stock. However, the bracket body may also be made of other material such as steel or a composite with the desired strength. Alternate shapes such as angle or channel sections may also be used. A plurality of paddles 30 are located along bracket body 20 at the desired spacing. Each paddle includes a clamp 35 to hold a steel stud or steel angle bracket. As shown in FIG. 1, clamp 35, may be a permanent magnet. In the alternative, toggle clamps or any of the fixed or portable clamps well known in the art may be employed. A positioning magnet 40 is attached to the bracket body 20 with magnet brackets 50. The positioning magnet 40 includes an on-off switch 45. Positioning magnet 40 may be a separately powered electro magnet or a permanent magnet. The positioning magnet 40 of the preferred embodiment is a switchable permanent magnet, and by operating the positioning magnet 40, on-off switch 45, the construction bracket 10 may be selectively secured to or released from the floor sidewall. Shown in figure is the long axis 60 of the device, the short axis 62, the first side 64 of the bracket body 20, the second side 66 of the bracket body 20, the top side 68 of the bracket body 20, and the bottom side 70 of the bracket body 20.

FIG. 2 is a plan view of the embodiment of FIG. 1 with the construction bracket 10. The paddles 30 and clamps 35 are spaced along the bracket body 20. In this embodiment, the positioning magnet 40 is secured to the bracket body 20 with two magnet brackets 50.

Figure 3:
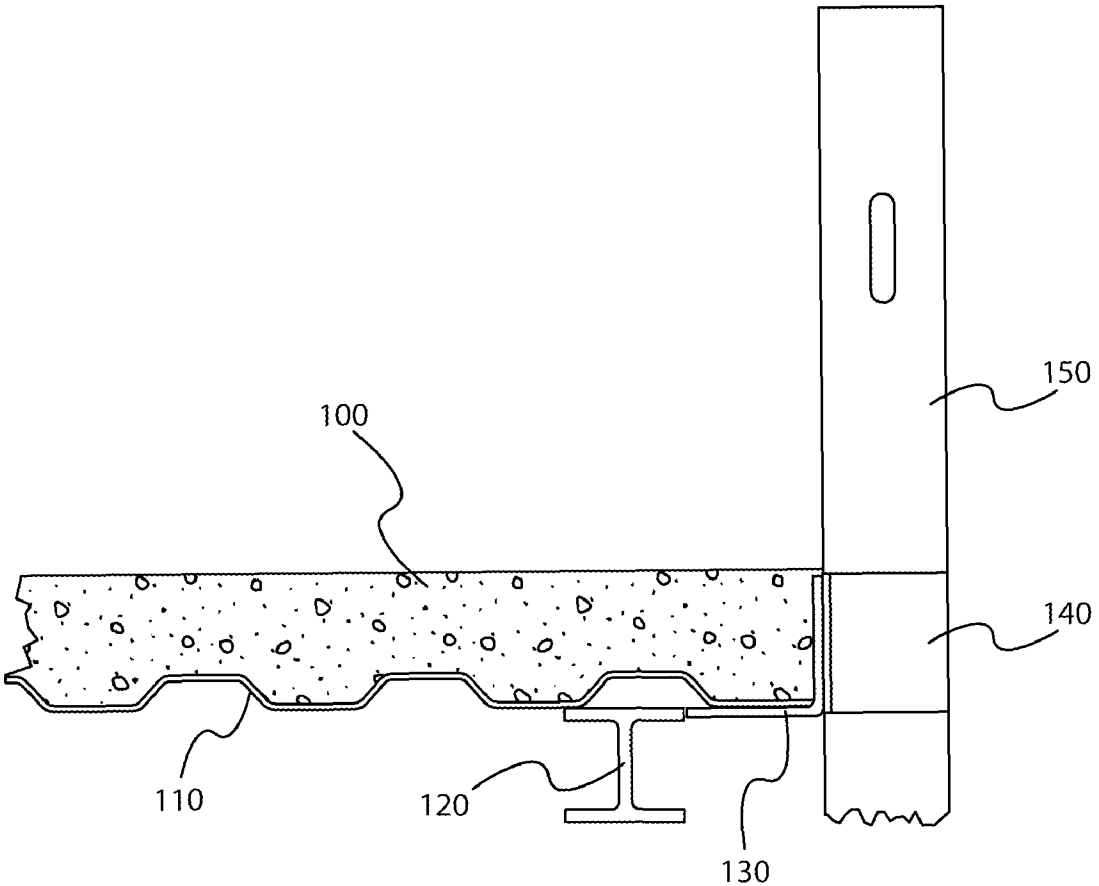
RELATED ART Fig. 3
FIG. 3 is an elevation of a typical building floor section.

FIG. 3 shows a typical building detail of a floor structure which includes concrete floor 100 that is poured into a steel floor pan comprised of a corrugated steel deck 110 bounded by a steel floor sidewall 130. The floor is supported by elements of the building structure such as beam 120. Steel angle brackets 140 are secured to the building structure, and then steel studs 150 are secured to the steel angle brackets 140. The normal order of assembly is to attach steel angle bracket 140 to vertical face of the floor sidewall 130 then the steel stud 150 is attached to the secured steel angle bracket 140. The most common method used for attaching the angle brackets and steel studs is electric arc welding.

The embodiment of FIG. 1 is shown in service in FIG. 4. The construction bracket 10 is setting along the edge of a floor 100 secured by the positioning magnet 40 to the vertical face of the floor sidewall 130. In FIG. 4 one steel angle bracket 140 is shown held in position for attachment to the floor sidewall 130 by a clamp 35 (not visible, behind steel angle bracket 140) on a paddle 30.

The exemplary embodiments shown in the figures and described above illustrate, but do not limit the invention. It should be understood that there is no intention to limit the invention to the specific form disclosed; rather, the invention is to cover all modifications, alternative constructions, and equivalents falling within the spirit and scope of the invention as defined in the claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A construction bracket to position and space steel studs and steel angle brackets along the edge of a building floor for attachment to the floor sidewall, comprising:

an elongated rectangular bracket body with a first side, a second side, a top edge, a bottom edge, a short axis and a long axis, said short axis and said long axis are both parallel with said first side and said second side, said short axis is perpendicular to said long axis of said bracket body, said bracket body is configured for placement adjacent to said floor sidewall;

at least one positioning magnet attached to said bracket body with said positioning magnet configured for removably attaching said bracket body to said sidewall of said building floor;

a plurality of generally planar paddles attached to said first side of said bracket body, said paddles normal to said bracket body first side and parallel to said short axis of bracket body; and each said paddle further comprising a clamp for removably holding said steel angle brackets or said steel studs to said paddle.

2. The construction bracket of claim 1 in which at least one said positioning magnet further comprises an on-off switch for activation or deactivation of said positioning magnet, whereby said positioning magnet on-off switch may be used to selectively attach or release said construction bracket to said building floor sidewall.

3. The construction bracket of claim 2 in which said positioning magnet is a permanent magnet.

4. The construction bracket of claim 1 in which said bracket body is configured for placement on a floor adjacent to said floor edge, with said first side of said bracket body positioned parallel to a vertical face of said floor sidewall.

5. The construction bracket of claim 1 in which said paddles are generally L shaped with a first leg and a second leg forming said paddle, said first leg of said paddle attached to said first side of said bracket body, said first leg extending beyond said floor edge away from said floor, and said second leg of said paddle extending down from said first leg when said construction bracket is positioned for use.

6. The bracket of claim 1 in which said clamp is one or more magnets.

7. A construction bracket for use with a floor sidewall, steel angle brackets and steel studs, comprising:

an elongated rectangular bracket body having a short axis a long axis, a first side, a second side, a top edge and a bottom edge, configured for placement adjacent to said floor sidewall;

at least one positioning magnet attached to said bracket body, said positioning magnet configured for attaching said bracket body to said floor sidewall;

a plurality of generally planar paddles attached to said first side of said bracket body normal to said first side and parallel with said short axis of bracket body, with each paddle positioned at a distance from adjacent paddles to a specified spacing for said steel studs with each paddle further comprising; a clamp for securing one said steel angle bracket or one said steel stud to said paddle.

8. The construction bracket of claim 7 in at least one said positioning magnet further comprises an on-off switch for activation or deactivation of said positioning magnet for attachment or release of said construction bracket body to said floor sidewall.

9. The construction bracket of claim 8 in which said positioning magnet with said on-off switch is comprised of a permanent magnet.

10. The construction bracket of claim 7 in which said bracket body is configured for placement on a floor adjacent to said floor sidewall, with said first side of said bracket body positioned parallel to said floor sidewall.

11. The construction bracket of claim 7 in which said paddles are generally L shaped with a first leg and a second leg forming said paddle, said first leg of said paddle attached to said first side of said bracket body, said first leg extending beyond said floor sidewall away from said floor, and said second leg of said paddle extending down from said first leg when said construction bracket is positioned for use.

12. The construction bracket of claim 7 in which each said clamp on each said paddle is one or more permanent magnets.

13. A construction bracket for use with a building having floor sidewalls, steel angle brackets and steel studs, comprising:

an elongated rectangular bracket body with a short axis, a long axis, a first side, a second side, a top edge, and a bottom edge, configured for placement on a floor adjacent to a floor sidewall, with said first side of said bracket body positioned parallel to said floor sidewall;

at least one positioning magnet attached to said bracket body, with said at least one positioning magnet configured for attaching said bracket body to said floor sidewall, said at least one positioning magnet further comprising an on-off switch for activation or deactivation of said positioning magnet for attachment or release of said construction bracket to said floor sidewall;

a plurality of generally planar paddles attached to said first side of said bracket body normal to said first side and parallel with said short axis of bracket body, with each said paddle spaced apart from adjacent paddles a distance equal to the desired spacing for steel studs, with said paddles generally L shaped with a first leg and a second leg forming said paddle, said first leg of said paddle attached to said first side of said bracket body, said first leg extending beyond said floor edge away from said floor, and said second leg of said paddle extending down from said first leg when said construction bracket is positioned for use with each said paddle additionally comprising; a clamp where said clamp is a permanent magnet, said clamp configured for removably holding one said steel angle bracket or one said steel stud to said paddle.

* * * * *